US006869213B2

(12) United States Patent
Cappellino

(10) Patent No.: US 6,869,213 B2
(45) Date of Patent: Mar. 22, 2005

(54) APPARATUS FOR INJECTING A CHEMICAL UPSTREAM OF AN INLINE MIXER

(75) Inventor: Charles A. Cappellino, Seneca Falls, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 169 days.

(21) Appl. No.: 10/199,616

(22) Filed: Jul. 17, 2002

(65) Prior Publication Data

US 2004/0013032 A1 Jan. 22, 2004

(51) Int. Cl.[7] ..... B01F 5/04
(52) U.S. Cl. ..... 366/171.1; 366/172.2
(58) Field of Search ..... 366/168.1, 169.2, 366/171.1, 172.2, 181.4

(56) References Cited

U.S. PATENT DOCUMENTS

| | | | | |
|---|---|---|---|---|
| 2,798,698 A | * | 7/1957 | Dooley | 366/141.1 |
| 3,818,938 A | | 6/1974 | Carson | |
| 4,068,830 A | | 1/1978 | Gray | |
| 4,114,195 A | | 9/1978 | Dirksing et al. | |
| 4,441,823 A | | 4/1984 | Power | |
| 4,564,298 A | | 1/1986 | Gritters et al. | |
| 4,573,803 A | | 3/1986 | Gritters et al. | |
| 4,715,393 A | | 12/1987 | Newton | |
| 4,753,535 A | | 6/1988 | King | |
| 4,858,965 A | | 8/1989 | Fuller et al. | |
| 5,452,955 A | | 9/1995 | Lundström | |
| 5,597,236 A | | 1/1997 | Fasano | |
| 6,076,955 A | | 6/2000 | Wallther | |
| 6,170,979 B1 | | 1/2001 | Smeaton | |
| 2001/0003291 A1 | * | 6/2001 | Uematsu et al. | 137/888 |

* cited by examiner

*Primary Examiner*—David Sorkin
(74) *Attorney, Agent, or Firm*—Ware, Fressola, Van Der Sluys & Adolphson LLP

(57) ABSTRACT

A new and unique inline mixer and process pipe combination includes an inline mixer with a casing and a rotor arranged therein. The casing has one or more stationary vanes and an inlet connected to a process pipe configuration. The rotor has one or more rotary vanes that rotate on an axis of rotation in the casing. The process pipe configuration includes a chemical injection pipe having a slotted injection pipe arranged therein having an outer surface with a long narrow slot therein oriented substantially parallel to the axis of rotation of the rotor for injecting a chemical into a process flow media flowing in the process pipe configuration. The long narrow slot is located on a downstream side of the outer surface and oriented in a plane parallel to the direction of flow of the process media.

19 Claims, 2 Drawing Sheets

APPARATUS FOR INJECTING A CHEMICAL UPSTREAM OF AN INLINE MIXER

BACKGROUND OF THE INVENTION

1. Field of Invention

The present invention relates to a method and apparatus for injecting a chemical into a process flow media; and more particularly relates to a method and apparatus for injecting a chemical into a process flow media upstream of an inline mixer.

2. Description of Related Art

FIG. 1 shows a simple method of injecting a chemical into a process flow media upstream of a dynamic mixer (see FIG. 4) in which the chemical flow generally indicated as F is introduced using a pipe 10 that joins a main process piping 12 in a perpendicular or angled fashion. Generally, the chemical injection piping 10 is arranged perpendicular to the main process piping 12 and is smaller in diameter than the main process piping 12. The chemical injection piping 10 may be introduced anywhere around the circumference of the main process piping 12 (i.e. the bottom, top or side). However, the method of adding the chemical flow using a perpendicular or angled connection does not introduce the chemical at the location for optimal mixing performance by the mixer rotor and stator blade configuration. The optimal location for entry into the mixer is the zone of highest shear and turbulence; this zone is generally not adjacent to the process piping walls. The addition of chemicals into a less than optimum location results in high and low concentrations of chemical, resulting in the need to add additional chemicals or accept less than desired mixing performance.

FIG. 2 shows a second method of injecting a chemical into a process flow media that utilizes single or multiple orifice plates 20, 22 in a main processing pipe 26. The orifice plates 20, 22 are used to create turbulence generally indicated as T to the flow generally indicated as F and initiate mixing of the chemical before entering the dynamic mixer (see FIG. 4). The chemical may be in an injection pipe 28 arranged introduced upstream, downstream of a single orifice plate 20 or 22 or may be introduced between a set of orifice plates 20, 22, as shown. The orifice plates 20, 22 may or may not be concentric with the inside of the main process piping 26. However, using orifice plates 20, 22 to add turbulence and mix the chemical before entering the inline mixer distributes the chemical and some of the chemical enters the mixer rotor (see FIG. 4) at less than optimal locations, such as areas of low shear and turbulence. Also, adding the chemical using orifice plates 20, 22 allows some of the chemical to bypass the mixer rotor (see FIG. 4) by passing around the outside of the mixer rotor. The orifice plates 20, 22 also create a large undesirable pressure drop in the process line, this pressure drop creates a requirement for additional pump pressure.

Other methods use plates or pipes with small holes to distribute the chemical. Again, these methods do not introduce the chemical to the optimal mixing location and many times are prone to plugging.

In view of this, there is a need in the industry for an improved inline mixer architecture to that known in the art.

SUMMARY OF INVENTION

The present invention provides a new and unique method of injecting chemical into a process flow media upstream of a dynamic mixer.

The present invention provides a new and unique inline mixer and process pipe combination having an inline mixer with a casing and a rotor arranged therein. The casing has one or more stationary vanes and an inlet connected to a process pipe configuration. The rotor has one or more rotary vanes that rotate on an axis of rotation in the casing. The process pipe configuration has a chemical injection pipe including a slotted injection pipe arranged therein having an outer surface with a long narrow slot therein oriented substantially parallel to the axis of rotation of the rotor for injecting a chemical into a process flow media flowing in the process pipe configuration. The long narrow slot is located on a downstream side of the outer surface and oriented in a plane parallel to the direction of flow of the process media.

In effect, this present invention uses a new and unique slotted injection pipe that traverses a process pipe and introduces the chemical at the optimal location for performance of the downstream dynamic mixer. The optimum chemical injection pipe location will introduce the chemical to the mixer rotor near the rotor periphery; this is the zone of highest shear and turbulence. The slot length is also parallel or nearly parallel to the axis of rotation of the mixer rotor, this allows the full length of the rotor to be used in the mixing process. The slotted injection pipe is located above the bottom of the process pipe such that the chemical is introduced along the area of interaction between the rotating and stationary vanes; this is the zone of highest shear and turbulence. The slotted injection pipe is also positioned such that process fluid is able to pass above and below the injection pipe; this ensures the injected chemical flow cannot flow under the mixer rotor and bypass the high turbulence zone. The narrow slot faces downstream and is also of sufficient width to prevent plugging with solids or fibers that may be within the process flow media.

The slotted injection pipe may be circular or oval in cross section and presents a small frontal area to the flow, thus resulting in a small pressure drop. Pressure drops are generally not desirable. The optimal mixing performance results in lower chemical usage and lower processing costs for the user. The slotted injection pipe may be a separate or an integral piece of the overall inline mixer and process pipe combination.

The slotted injection pipe is located upstream of the high turbulence dynamic inline mixer device. The slotted injection pipe protrudes through the process pipe with a connection available at either or both ends. The slotted injection pipe may be included as part of a separate spool piece or may be made to be part of the mixer inlet piping. The chemical can be supplied to either or both ends of the slotted injection pipe from an external source and flows out of a slot on the downstream side of the slotted injection pipe. The slotted injection pipe and narrow slot are sized to introduce a sheet of chemical into the process stream. The slotted injection pipe and narrow slot are optimally positioned such that the sheet of chemical will intersect the full length, or nearly the full length, and near the periphery of the rotating vanes of the mixer rotor, this is the high turbulence zone of the mixer rotor and stationary vanes. The slotted injection pipe is also positioned such that process flow media is able to pass above and below the slotted injection pipe; this ensures the injected chemical flow cannot flow under the mixer rotor and bypass the high turbulence zone. As described above, the slotted injection pipe position is based on the location of the interaction of the rotating and stationary mixer vanes. This location is generally based on the height of the stationary vanes of the mixer. For best mixing performance, the slotted injection pipe is positioned above the bottom of the process pipe by at least 20% of the mixer stationary vane height and at least the same distance away from the top of the process pipe. The injection pipe should also be positioned with at least a 0.5 inch clearance between the slotted injection pipe and the bottom of the process pipe. Thus, the slotted injection pipe and the mixer rotor operate as a system designed for maximum mixing performance. The slotted injection pipe may be used for injecting either liquid or gases to be mixed in the downstream mixing device.

The scope of the invention is also intended to include a method for injecting a chemical into a process flow media flowing in a process pipe configuration comprising at least two steps. In a first step, an injection pipe having an outer surface with a narrow slot therein and an opening is arranged in the process pipe configuration so that the longitudinal length of the narrow slot is substantially perpendicular to the direction of flow of the process flow media. In a second step, the chemical is injected into the opening of the slotted injection pipe so that the chemical flows out of the narrow slot into the process flow media flowing in the process pipe configuration.

BRIEF DESCRIPTION OF THE DRAWING

The drawing, not drawn to scale, includes the following Figures.

DETAILED DESCRIPTION OF INVENTION

Figure 1:
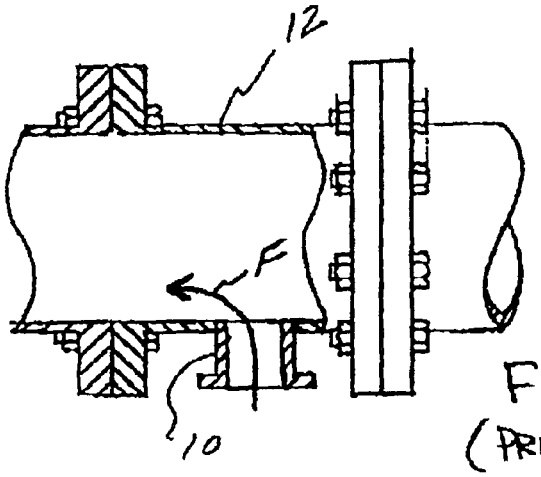
FIG. 1 (PRIOR ART)
FIG. 1 is a view of a known process pipe in combination with a known chemical injection pipe.
Figure 2:
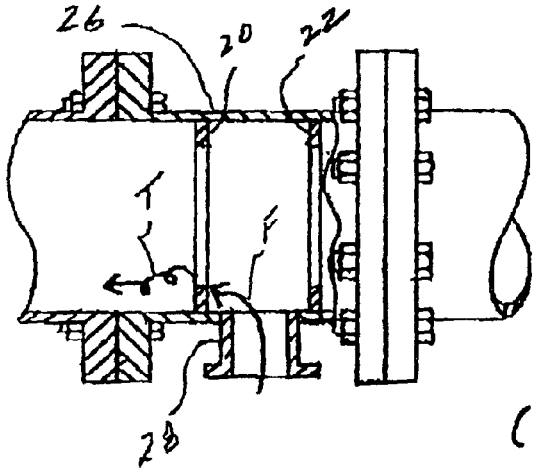
FIG. 2 (PRIOR ART)
FIG. 2 is a view of another known process pipe in combination with another known chemical injection pipe.
Figure 3:
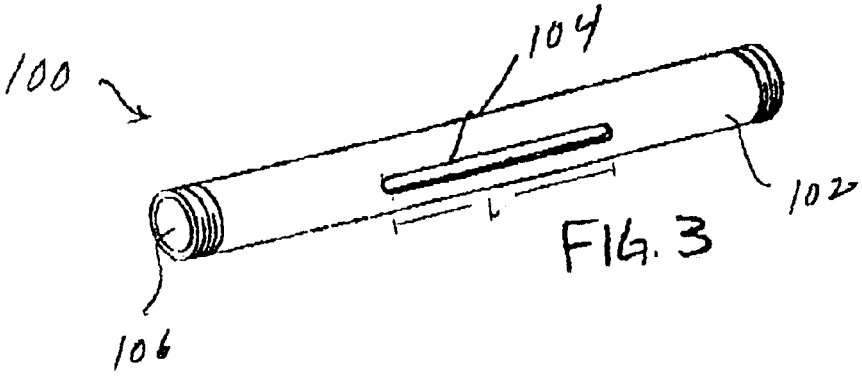
FIG. 3 is a perspective view of a slotted injection pipe that is the subject matter of the present invention.

FIG. 3 shows a slotted injection pipe generally indicated as 100 having an outer surface 102 with a long narrow slot 104 therein and one or more openings 106 according to the present invention.

Figures 4, 5:
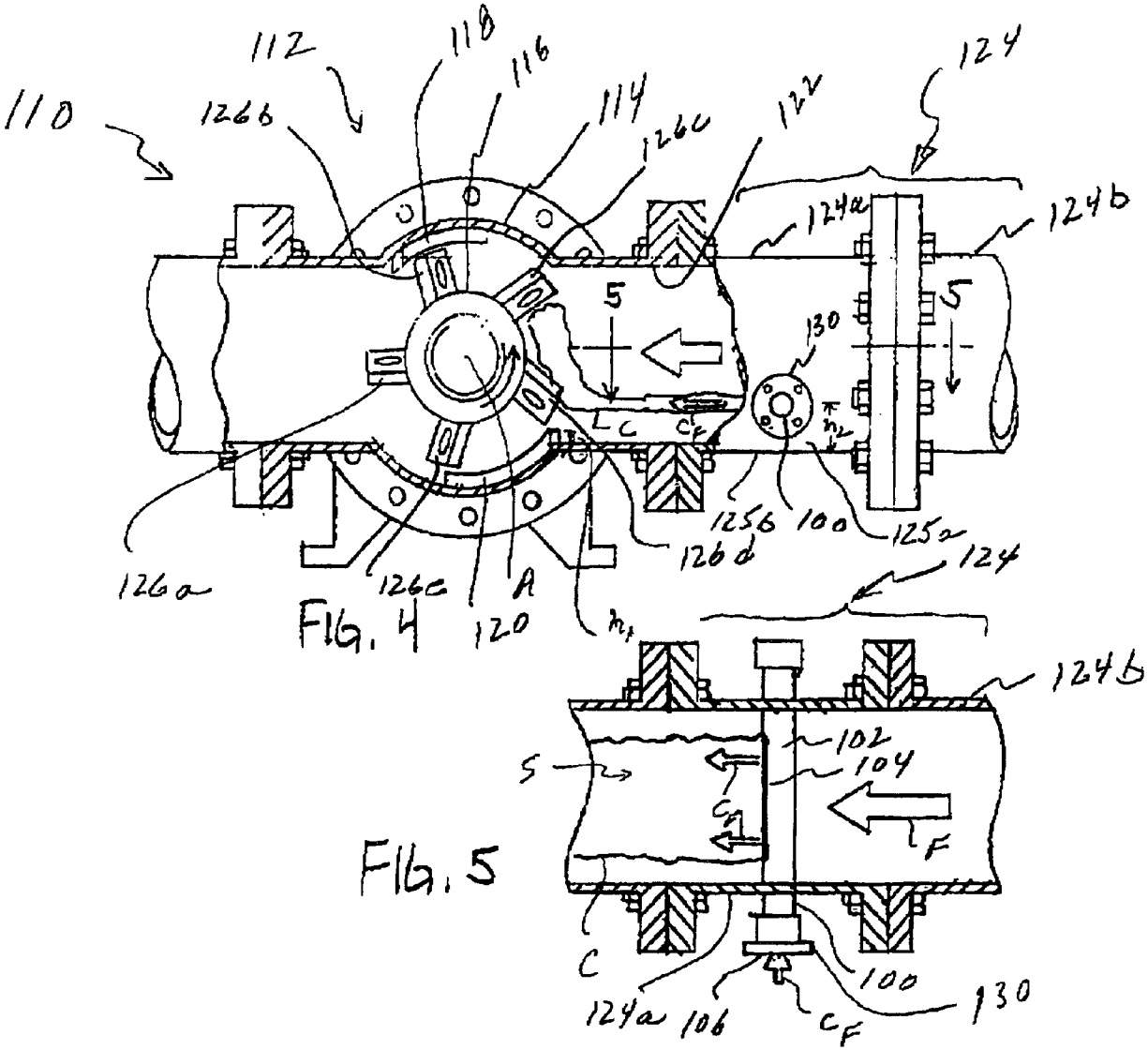
FIG. 4 is a diagram of an inline mixer connected to a process pipe having the slotted injection pipe arranged therein according to the present invention.
FIG. 5 is a diagram of the slotted injection pipe arranged in the process pipe according to the present invention.

FIG. 4 shows an inline mixer and process pipe combination generally indicated as 110 having an inline mixer generally indicated as 112 with a casing 114 and a rotor 116 arranged therein. The casing 112 has one or more stationary vanes 118, 120 and an inlet 122 connected to a process pipe configuration 124. For the purpose of describing the invention, the process pipe configuration 124 is shown and described as including two pipes, i.e. a chemical injection pipe 124*a* and a main process pipe 124*b*, each having flanges for coupling together with a bolting arrangement. The chemical injection pipe 124*a* is arranged between the main process pipe 124*b* and an inlet 122 of the inline mixer 112, and similarly coupled thereto. The rotor 116 has one or more rotary vanes 126*a*, 126*b*, 126*c*, 126*d*, 126*e* that rotate on an axis of rotation A (the axis A is directed into and from the page) in the casing 112. The scope of the invention is not intended to be limited to the overall configuration of the casing 100 or the rotor 116 shown and described herein. For example, embodiments are envisioned having a casing with a different stationary vane configuration or a different rotor configuration than that shown and described herein.

FIG. 5 shows the chemical injection pipe 124*a* having the slotted injection pipe 100 arranged therein and oriented substantially parallel to the axis of rotation A of the rotor 116 for injecting a chemical generally indicated as C into a process flow media F flowing in the process pipe 124. The chemical flow is indicated by the symbol $C_F$ in FIGS. 4–5. The scope of the invention is not intended to be limited to the slotted injection pipe 100 being only arranged in the chemical injection pipe 124*a*. Embodiments are envisioned in which the slotted injection pipe 100 is arranged in the inlet 122 of the casing 112, as well as the main process pipe 124*b* itself.

In FIG. 5, the long narrow slot 104 is located on a downstream side of the outer surface 102 and oriented in a plane parallel to the direction of flow F of the process flow media. As shown, the longitudinal length L of the long narrow slot 104 is also oriented substantially perpendicular to the direction of flow F of the process flow media. The slotted injection pipe 100 is arranged in the chemical injection pipe 124*a* so as to introduce the chemical C to the inline mixer 112 near the periphery of the rotor 126 as best shown in FIG. 4. Embodiments are envisioned in which the long narrow slot 104 is rotated upwardly or downwardly in relation to that shown in FIG. 5 to change the performance of the chemical injection.

The slotted injection pipe 100 is shown located in a lower part 124*a* of the chemical injection pipe 124*a* and above the bottom 125*b* of the chemical injection pipe 124*a* so that the chemical C is introduced along an area of interaction between the rotating vanes 126*a*, 126*b*, 126*c*, 126*d*, 126*e* and the one or more stationary vanes 118, 120. The slotted injection pipe 100 is positioned in the chemical injection pipe 124*a* so that process flow media passes above and below the slotted injection pipe 100. The long narrow slot 104 faces downstream of the direction of the process flow F and has a suitable width to prevent the plugging thereof with solids or fibers that may be within the process flow media. The slotted injection pipe 100 may be circular or oval in cross section to present a small frontal area to the flow, thus resulting in a small pressure drop. The slotted injection pipe 100 may be either a separate pipe or an integral piece of the inline mixer and main process pipe combination.

The slotted injection pipe 100 is located upstream of an inline mixer 112. The slotted injection pipe 100 protrudes through both walls of the chemical injection pipe 124*a* with a connection 130 at either or both ends for receiving the chemical C. The slotted injection pipe 100 has openings 106 at either or both ends for receiving the chemical C from an external source (not shown) that flows out of the long narrow slot 104 on the downstream side of the slotted injection pipe 100. The slotted injection pipe 100 and the long narrow slot 104 are sized to introduce a sheet of chemical generally indicated as S in FIG. 5 into the process flow media. The slotted injection pipe 100 and the long narrow slot 104 are suitably positioned so that the sheet of chemical S will intersect the full length, or nearly the full length, and near the periphery of the rotary vanes 126*a*, 126*b*, 126*c*, 126*d*, 126*e* of the inline mixer 112. As shown, the slotted injection pipe 100 is positioned in a location at an interaction of the rotary vanes 126*a*, 126*b*, 126*c*, 126*d*, 126*e* and the one or more stationary vanes 118, 120. The exact location of the slotted injection pipe 100 depends on the height $h_1$ of the stationary vanes 118, 120 of the inline mixer 112. For example, the slotted injection pipe 100 is shown positioned at a height $h_2$ above the bottom 125*b* of the chemical injection pipe 124*a* by at least 20% of the height $h_1$ of the one or more stationary vanes. The slotted injection pipe 100 is also positioned with at least a 0.5 inch clearance between the slotted injection pipe 100 and the bottom 125*b* of the chemical injection pipe 124*a*. The slotted injection pipe 100 injects either liquid, gases or a combination thereof to be mixed in the inline mixer 112.

It is noteworthy to mentioned that the scope of the invention is not intended to be limited to using only one long narrow slot. Embodiments are envisioned using multiple long narrow slots, as well as one or more radial slots extending perpendicular to the tubular axis of the slotted injection pipe 100. Embodiments are also envisioned in which the slotted injection pipe 100 protrudes through only one of the walls of the chemical injection pipe 124*a*.

LIST OF ALL POSSIBLE APPLICATIONS

Possible applications include:

1) Mixing of multiple media to create a homogenous mixture;

2) Mixing multiple liquids;

3) Mixing a liquid into a liquid suspension of solids or fibers;

4) Mixing gases into a liquid;

5) Mixing gases into a liquid suspension of solids or fibers;

6) Mixing two chemicals to promote a reaction;

7) Chemical treatment of fibers; and

8) Chemical treatment of fibers used to create paper products.

SCOPE OF THE INVENTION

Accordingly, the invention comprises the features of construction, combination of elements, and arrangement of parts which will be exemplified in the construction hereinafter set forth.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

What is claimed is:

1. An inline mixer and process pipe combination having an inline mixer with a casing and a rotor arranged therein, the casing having one or more stationary vanes and an inlet connected to a process pipe configuration, the rotor having one or more rotary vanes that rotate on an axis of rotation in the casing, characterized in that the process pipe configuration includes a slotted injection pipe arranged therein having a connection for receiving a chemical to be injected into a process flow media, and having an outer surface with a long narrow slot therein oriented substantially parallel to the axis of rotation of the rotor for injecting the chemical into the process flow media flowing in the process pipe configuration, the slotted injection pipe protruding through the process pipe configuration with the connection at either or both ends for receiving the chemical.

2. An inline mixer and process pipe combination according to claim 1, wherein the long narrow slot is located on a downstream side of the outer surface and oriented in a plane parallel to the direction of flow of the process media.

3. An inline mixer and process pipe combination according to claim 1, wherein the long narrow slot is oriented perpendicular to the longitudinal axis of the process pipe.

4. An inline mixer and process pipe combination according to claim 1, wherein the longitudinal length of the long narrow slot is oriented substantially perpendicular to the direction of flow of the process flow media.

5. An inline mixer and process pipe combination according to claim 1, wherein the slotted injection pipe is arranged in the process pipe configuration so as to introduce the chemical to the inline mixer near the periphery of the rotor.

6. An inline mixer and process pipe combination according to claim 1, wherein the slotted injection pipe is located in a lower part of a processing pipe and above the bottom of the process pipe so that the chemical is introduced along an area of interaction between the rotating vanes and the one or more stationary vanes.

7. An inline mixer and process pipe combination according to claim 1, wherein the slotted injection pipe is positioned in a process pipe so that process flow media passes above and below the slotted injection pipe.

8. An inline mixer and process pipe combination according to claim 1, wherein the long narrow slot faces downstream of the direction of the process flow and has a suitable width to prevent the plugging thereof with solids or fibers that may be within the process flow media.

9. An inline mixer and process pipe combination according to claim 1, wherein the slotted injection pipe is circular or oval in cross section to present a small frontal area to the flow, thus resulting in a small pressure drop.

10. An inline mixer and process pipe combination according to claim 1, wherein the slotted injection pipe is either a separate pipe or an integral piece of the inline mixer and process pipe combination.

11. An inline mixer and process pipe combination according to claim 1, wherein the slotted injection pipe is located upstream of an inline mixer.

12. An inline mixer and process pipe combination according to claim 1, wherein the slotted injection pipe has openings at either or both ends for receiving the chemical from an external source that flows out of the long narrow slot on the downstream side of the slotted injection pipe.

13. An inline mixer and process pipe combination according to claim 1, wherein the slotted injection pipe and the long narrow slot are sized to introduce a sheet of chemical into the process flow media.

14. An inline mixer and process pipe combination according to claim 1, wherein the slotted injection pipe and the long narrow slot are suitably positioned so that a sheet of chemical will intersect the full length, or substantially the full length, and near a periphery of the rotary vanes of the inline mixer.

15. An inline mixer and process pipe combination according to claim 1, wherein the slotted injection pipe is positioned in a location at an interaction of the rotary vanes and the one or more stationary vanes.

16. An inline mixer and process pipe combination according to claim 15, wherein the location depends on the height of the stationary vanes of the inline mixer.

17. An inline mixer and process pipe combination according to claim 1, wherein the slotted injection pipe is positioned above the bottom of a process pipe by at least 20% of the height of the one or more stationary vanes and at least the same distance away from the top of the process pipe.

18. An inline mixer and process pipe combination according to claim 1, wherein the slotted injection pipe is positioned with at least a 0.5 inch clearance between the slotted injection pipe and the bottom of a process pipe.

19. An inline mixer and process pipe combination according to claim 1, wherein the slotted injection pipe injects either liquid, gases or a combination thereof to be mixed in the inline mixer.

* * * * *